United States Patent [19]

Behr

[11] 4,171,777

[45] Oct. 23, 1979

[54] ROUND OR ANNULAR JET NOZZLE FOR PRODUCING AND DISCHARGING A MIST OR AEROSOL

[76] Inventor: Hans Behr, Lenzhalde 82, Stuttgart 7000, Fed. Rep. of Germany

[21] Appl. No.: 876,127

[22] Filed: Feb. 8, 1978

[30] Foreign Application Priority Data

Nov. 2, 1977 [DE] Fed. Rep. of Germany ..... 2705706

[51] Int. Cl.[2] ..... B05B 7/06

[52] U.S. Cl. ..... 239/422; 239/433

[58] Field of Search ..... 239/419.3, 422, 423, 239/424, 428, 433, 222.17

[56] References Cited

U.S. PATENT DOCUMENTS

| | | | |
|---|---|---|---|
| 3,059,613 | 10/1962 | Nakaya | 239/697 |
| 3,346,412 | 10/1967 | Siegenthaler et al. | 239/424.5 X |
| 3,484,048 | 12/1969 | Mobius | 239/424 |

*Primary Examiner*—Robert W. Saifer
*Attorney, Agent, or Firm*—Martin A. Farber

[57] ABSTRACT

A round or annular jet nozzle for the production and discharge of a mist or aerosol for coating objects, including a nozzle cap forming the axial front end of the nozzle, a nozzle body mounting the cap, which nozzle body has two channels for feeding of flowable coating material such as lacquer or paint powder, and respectively, for feeding of an atomization gas standing under pressure such as pressurized air, the two channels extending at least partly parallel to the nozzle axis, an annular-shaped atomization chamber into which the two feed channels exit approximately parallel, and with a conical annular gap for the exit of the mist and aerosol, respectively, the annular gap diverging forwardly with respect to the nozzle axis, the annular gap standing in connection with the atomization chamber. The atomization chamber and the annular gap pass directly into each other, the opening angle of the conical mouth of the annular-shaped material feed channel corresponds at least approximately to the opening angle of the annular gap, and the mouth is aligned with the annular gap. A second channel is provided for feeding of the atomization gas standing under pressure and the two annular-shaped gas feed channels respectively open into the atomization chamber under a flat acute angle relative to the mouth of the material feed channel such that the two annular-formed gas streams penetrate into the material stream from different sides.

7 Claims, 2 Drawing Figures

ROUND OR ANNULAR JET NOZZLE FOR PRODUCING AND DISCHARGING A MIST OR AEROSOL

Figure 1:
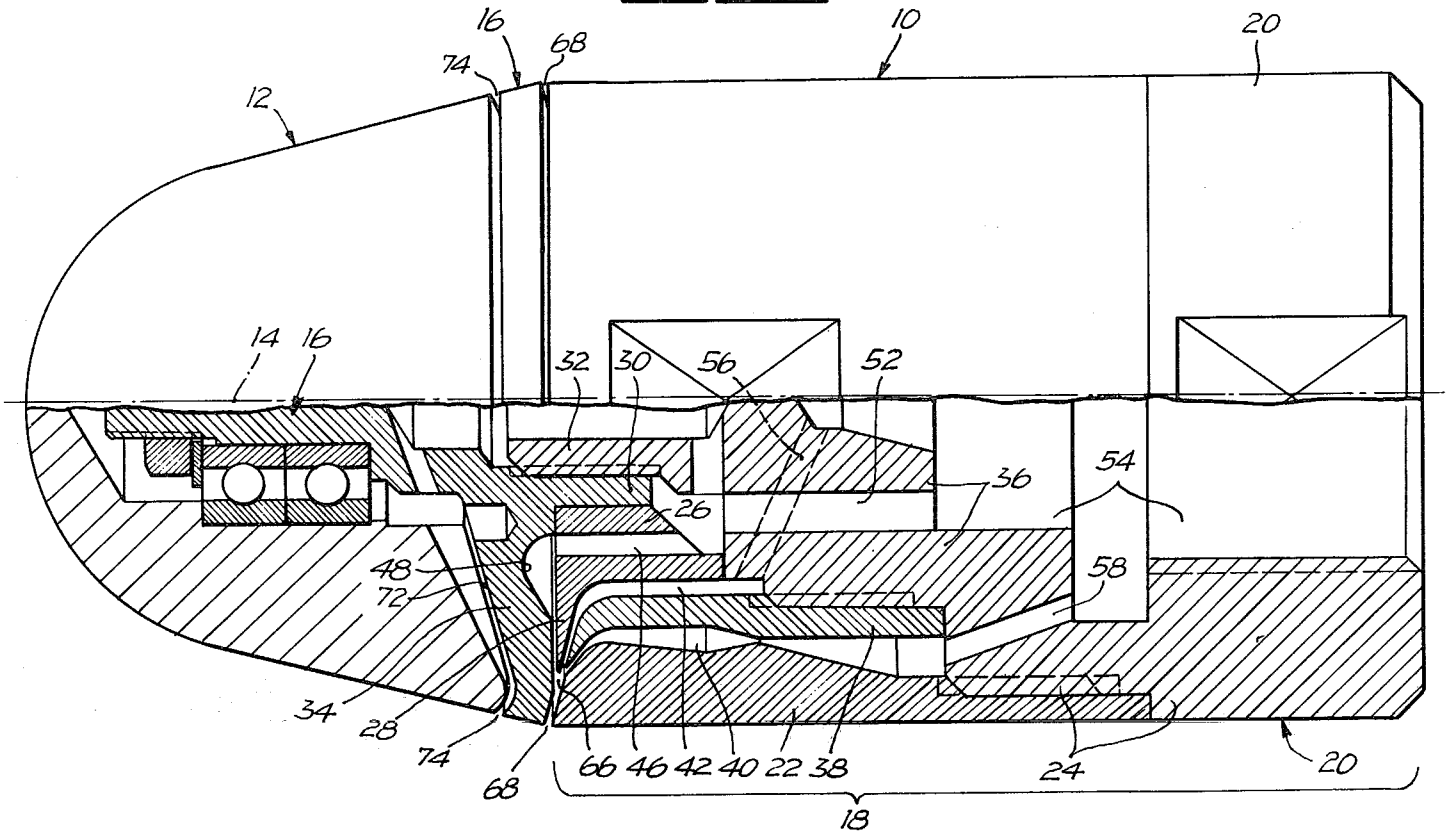

The invention relates to a round or annular jet nozzle for the production and emitting of a mist or aerosol for coating objects, including a nozzle cap forming the axial front end of the nozzle, a nozzle body mounting the cap, which nozzle body has two channels for feeding of flowable coating material such as lacquer or paint powder, and respectively, for feeding of an atomization gas standing under pressure such as pressurized air, the two channels extending at least partly parallel to the nozzle axis, an annular-shaped atomization chamber into which the two feed channels exit approximately parallel, and with a conical annular gap for the exit of the mist and aerosol, respectively, the annular gap diverging forwardly with respect to the nozzle axis, the annular gap standing in connection with the atomization chamber.

A nozzle of this type is known from German Pat. No. 1 280 104, which relates to a "radial spray nozzle" for separated interior atomization of a liquid and of a powder, respectively, and for the outer mixing of the developing mist with the aerosol which arises, having an annular channel connecting the outer periphery annular gap for the exit of the mist with the central interior chamber for the atomization of the liquid coating material, the length of which channel measured in the flow direction is comparatively long in comparison to the dimension of the atomization chamber and this channel steadily deflects the mist which exits almost axially from the atomization chamber up to the annular gap by approximately 90° almost into a radial plane. This annular channel thus provides an undesired flow resistance and forms a hollow space. With a change of the coating material first this hollow space must be blown empty, so that a material loss and time loss occurs.

With the known nozzle the liquid coating material flows along the nozzle axis toward the point of a cone, the jacket surface of which constitutes the radial inner boundary surface of the annular-shaped atomization chamber and the point of which projects more or less into an axially parallel, axially displaceable tube which forms the material feed channel. The inner annular edge of the mouth of the tube, which mouth lies opposite to the cone, forms an exit cross-section together with the cone jacket surface, the exit cross-section not being further defined, when the cone point does not project into the tube. If as the opening angle of the mouth of the material feed channel, the opening angle of the jacket of the cone which projects into the tube is considered, then independent of how far the cone projects into the tube, this opening angle neither corresponds with the opening angle of the annular gap for the exit of the mist nor is aligned with this annular gap. With the known nozzle that is also not required since the atomization chamber for the production of the mist and the annular gap for the exit of the mist are connected with each other by the mentioned annular channel.

The single gas (or air) feed channel which opens into the atomization chamber of the known nozzle is partially helically-formed and has an annular-shaped, substantially axial mouth or opening, the radial outer boundary surface of which transfers or passes smoothly into the radial outer boundary surface of the atomization chamber, in which the whirling atomization gas "turbulizes" and thereby atomizes the liquid coating material, which is admitted into the chamber, moderately well.

It is true that the known nozzle has a second gas (or air) feed channel. However this does not open into the atomization chamber in which mist originates, but rather into a second atomization chamber, in which the introductory mentioned aerosol is formed, which aerosol mixes with the mist outside of the nozzle.

It is an object of the present invention to provide a flow-technically favorable low loss nozzle of the introductory-mentioned type, which without large expense, by means of a very strong atomization of the coating material produces a homogeneous mist with finest material droplets or a likewise homogeneous aerosol in which the material particles are agglomerated as little as possible.

It is another object of the present invention to aid the solution of the above-mentioned object in the manner that the atomization chamber (66) and the annular gap (68) pass directly into one another, the opening angle of the conical mouth (62) of the annular-shaped material feed channel (42) corresponds at least approximately to the opening angle of the annular gap (68), and the mouth (62) is aligned with the annular gap (68), a second channel (44) for feeding of the atomization gas under pressure being provided and the two annular-shaped gas feed channels (40, 44) respectively open into the atomization chamber (66) at a flat acute angle relative to the mouth (62) of the material feed channel (42) such that the two annular-formed gas streams penetrate substantially centrally into the material stream in the atomization chambers from different sides. In this manner not only are the described disadvantages of the known similar nozzles avoided, but rather first of all the coating material is atomized better. This is based on the facts that the coating material not only is subjected to the feed pressure, but rather also to the injector effect of both openings or mouths of the two gas feed channels, that by the attainable high flow speeds of the coating material and of the atomization gas during the exit into the atomization chamber in it a very strong turbulence occurs, that the very narrow executeable gap-type opening of the material feed channel permits a thin material film to exit into the atomization chamber and that the mist which is produced in the atomization chamber or the there originating aerosol is emitted under strong pressure in the shortest manner into the open or ambient.

An important advantage of the nozzle according to the invention moreover is to be noted in that with volatile solvents containing thin-bodied lacquers as coating materials, the lacquer to be applied scarcely has time and opportunity to gassify a quantity of solvent worth mentioning and to give off air used in the conventional manner as atomization gas. The cause for this is the short sorjourn time or time of direct contact of the lacquer in the atomization chamber, the direct exit of the lacquer mist by the annular gap, the high kinetic energy of the compressed air during the entrance into the atomization chamber and the small air quantity which is used and is saturated quickly with solvent, the small air quantity being attributed to the small cross-section.

The second gas feed channel (44) of a preferred embodiment of the nozzle in accordance with the invention extends partially in a radial plane directed at an angle relative to the axis of the mouth (62) of the material feed channel and the second gas feed channel (44) is formed there by two axial joined or assembly parts (28, 34) of the nozzle body (10), so that there exists a simpler and more suitable construction of the channel section which opens into the atomization chamber. In addition, the axial front part (16) of the nozzle body (10) on its rear side has an annular-shaped hollow throat or groove (48) for reversing or turning around the axial-parallel inflowing atomization gas into the radial plane. The hollow groove (48) distributes the atomization gas which flows-in in places, for example through bores, uniformly about the nozzle periphery and with its relatively large volume causes an acceleration of the gas flow in the second gas feed channel between the hollow groove and the atomization chamber.

The preferred embodiment is moreover characterized in the manner that the axial rear part (18) of the nozzle body (10) substantially is made of a radial outer nozzle jacket (22), a radial inner flange part (26) and a radial center flange (38), the latter together with the nozzle jacket (22) and the flange part (26) form the one gas feed channel (40) and the material feed channel (42), and the front side of the flange (28) on the flange part (26) together with the rear side of the front part (16) of the nozzle body (10) as well as a plurality of bores (46) in the flange part (26), which bores exit into the hollow groove (48), form the second gas feed channel (44).

The principle of this nozzle construction was proved and permits a simple assembly and disassembly of the nozzle.

When the nozzle cap (12) and the nozzle body (10) form, as with the preferred embodiment, a second annular gap (72) for the exit of compressed guided air, which has a conically forwardly diverging opening (74) into the ambient with an opening angle which is at highest as large as the opening angle of the axially further rearward arranged annular gap (68) for the exit of the mist and aerosol, respectively, and practically is held somewhat smaller, it prevents on the one hand a strong soiling of the cap by coating material to be applied and prevents on the other hand a radial collapse of the round or annular-shaped mist stream or aerosol stream. With the proper selection of pressure and through-put of the guided air indeed it can be achieved that the stream (material-dispersion) exiting from one of the annular gaps is radially further opened than that which can be effected without guided air from the fixed geometry of this annular gap. Since however it has been shown that in spite of the guided air some material particles disturbingly appear on the nozzle cap, with the preferred embodiment the nozzle cap (12) is mounted on the nozzle body (10) rotatable about the nozzle axis (14) and a pneumatic drive of the nozzle cap (12) is provided by means of the guided air exiting from the second annular gap (72). The pneumatically driven rotating nozzle cap, which per se goes back to an old particular proposal, spins off adhering coating material, which promotes the centrifical force, and makes the adhering of coating material more difficult.

The two gas feed channels (40, 44) and the second annular gap (72) of the preferred embodiment are connected with one another and are connectable to the same source of pressurized air, which has the advantage that the nozzle needs only two connections, namely one for the pressurized air, and one for the flowable coating material.

Figure 2:
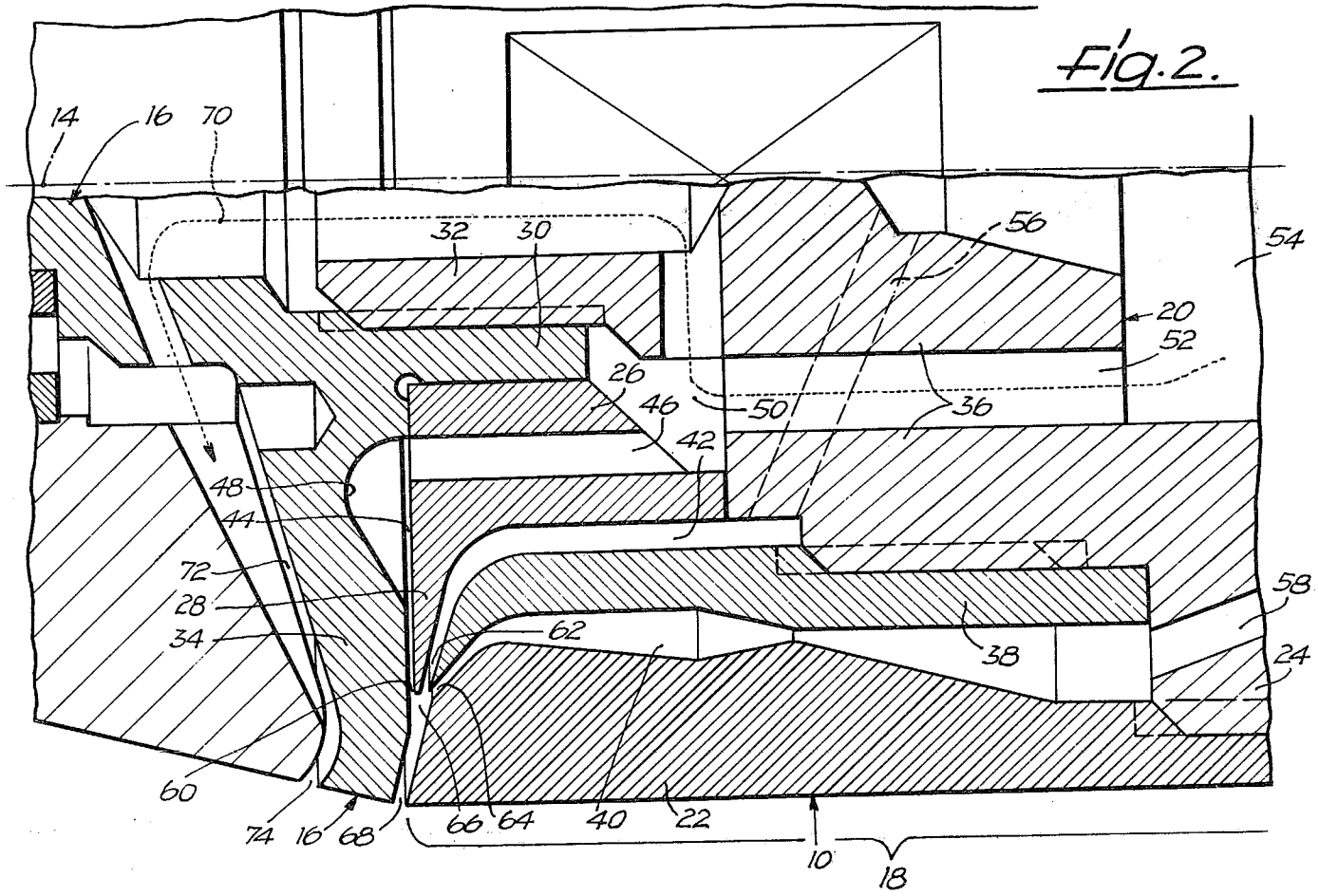

With the above and other objects and advantages in view, the present invention will become more clearly understood in connection with the following detailed description of a preferred embodiment, when considered with the accompanying drawings, of which:

FIG. 1 is a side view of an embodiment of a discharge nozzle in accordance with the invention above the nozzle axis, and below the nozzle axis a central longitudinal section through the embodiment; and FIG. 2 is an enlarged part of the longitudinal section of FIG. 1.

The illustrated embodiment substantially comprises a multi-part nozzle body 10 and a nozzle cap 12 forming the axial front end of the nozzle. The body and cap with respect to a nozzle axis 14 are formed in size and totality rotationally-symmetrically. The nozzle body 10 in turn is made of two axially joined parts, namely an axial front part 16 and an axial rear part 18. The main integral or component parts of the axial rear part 18 of the nozzle body 10 are: a stepped-off core part 20; a radially outer nozzle jacket 22, which is screwed onto the rear section 24 of the core part 20; a radially inner flange part 26, which with its flange 28 pointing forward is plugged or inserted from behind on an axial projection or continuation 30 of the axial front part 16, whereby this integral part 16 is screwed on the front section 32 of the core part 20, and between a particularly formed flange 34 of the axial front part 16 on the one hand and is axially fixed to the middle section 36 of the core part 20; and a radially center flange 38, which together with the nozzle jacket 22 and the flange part 26 form an annular-shaped first channel 40 for feeding of an atomization gas which stands under pressure such as pressurized air, and respectively, a channel 42 for feeding of a flowable coating material, such as lacquer, varnish, enamel or color, color dye or paint powder. A second gas feed channel is formed by the front side of the flange 28 on the flange part 26 together with the rear side of the flange 34 on the front part 16 of the nozzle body 10 as well as by a plurality of continuous bores 46 passing through the flange part 26, which bores are axially parallel and distributed uniformly about the periphery of the nozzle, which discharge into an annular-shaped hollow throat or groove 48 which is formed on the rear side of the flange 34 on the front part 16 of the nozzle body 10. The groove 48 reverses or turns the axially parallel inflowing atomization gas into a radial plane which separates the front side of the flange 28 and the rear side of the flange 34 from each other. The rear side of the flange part 26, the rear face surface of the extension 30 as well as the two sections 32 and 36 of the core part 20 form an annular intermediate space 50 into which beside the bores 46, additional axially-parallel through-passing bores 52 open, which bores 52 are uniformly distributed over the nozzle periphery, which bores 52 discharge in back into a collection chamber 54 formed by the core part 20. The front end of this collection chamber 54 and the rear end of the annular-shaped material feed channel 42 are connected with one another by bores 56 in the middle section 36 of the core part 20, which bores 56 sharply diverge toward the front and are arranged in the peripheral direction off-set relative to the bores 52 and uniformly distributed over the nozzle periphery. A further connection exists between the rear end of the annular-shaped first gas feed channel 40 and the collection chamber 54 in the form of a plurality of forward diverging bores 58 distributed likewise as the bores 52 uniformly about the nozzle periphery. After the insertion or mounting of the core part 20 of the nozzle body 10 on a not illustrated bearing part with two channels for the supply of coating material and atomization gas, respectively, which join or connect into the collection chamber 54 of the core part 20, the material feed channel 42 is connected via the bores 56 to a source which feeds a coating material under pressure and the two gas feed channels 40 and 44 are connected via the bores 58 and 52, respectively, to, for example, a compressed air source or another source delivering atomization gas standing under pressure.

The annular-shaped edge of the flange 28 on the flange part 26 forms on the one side with the flange 34 on the front part 16 of the nozzle body 10 and on the other side with the annular-shaped edge of the forwardly flared or widening flange 38, the radial annular-shaped mouth 60 of the second gas feed channel 44 and the almost radial, conically, annular-shaped mouth 62 of the material feed channel 42.

Moreover the mentioned edge of the flange 38 and the nozzle jacket 22 form the conical, annular-shaped mouth 64 of the first gas feed channel 40. The three mouths 60, 62 and 64 converge moderately sharply toward the atomization chamber 66, in which the annular-formed gas streams or jets which exit from both of the channels 40 and 44 penetrate at a flat acute angle relative to the opening angle of the mouth 64 from different sides into the annular-shaped material stream exiting from the channel 42, so that the material in the chamber 66 is atomized into a mist or aerosol. The atomization chamber 66 basically is bound by the front face surface of the nozzle jacket 22 and the rear side of the flange 34 on the front part 16 of the nozzle body 10. It stands in direct connection with an almost radial, first annular gap 68 therefore very sharply diverging toward the front, which gap likewise is formed by the nozzle jacket 22 and the flange 34 and which with correspondence or coincidence of the conical opening angles is in alignment with the mouth 62 of the material feed channel 42. The gap widths of the three channel mouths amount to 0.10 to 0.15 mm, whereby the mouths 60 and 64 are somewhat wider than the mouth 62 lying therebetween. The width of the first annular gap amounts to the contrary to approximately 0.25 mm.

The hollow nozzle cap 12 is rotatably mounted about the nozzle axis 14 on the front part 16 of the nozzle body 10 and a pneumatic drive of the nozzle cap is provided by means of the compressed air which is used only partially as the atomization gas, which compressed air arrives from the intermediate space 50 along the flow path 70 indicated in FIG. 2 through the forward section 32 of the core part 20 of the nozzle body 10 and its front part 16 also to the rear side of the nozzle cap 12. The mounting and drive of the nozzle cap 12 are evident from FIG. 1 and do not need to be explained in detail, since the German Offenlegeschrift OS No. 2 517 716 therefore provides an example, which for this embodiment form is unsubstantially modified. The compressed air, by means of its output placing the nozzle cap 12 in rotation about the nozzle axis 14, enters into a conical second annular gap 72 which diverges rearwardly, the annular gap 72 being formed by the rear side of the nozzle cap 12 and the front side of the front part 16 of the nozzle body 10, and through a forwardly diverging conical mouth 74 of the second annular gap enters as compressed guided air into the ambient. The angle of opening of the mouth 74 is somewhat smaller than the opening angle of the axially further rearwardly arranged first annular gap 68, so that the annular-formed mist jet stream or aerosol jet stream which exits there, indeed is not disturbed by the guided air, however is impeded or hindered at a radial contraction or constriction. The cap width of the mouth 74 amounts to 0.30 to 0.35 mm.

Only the nozzle body 10 stands under electrical high voltage, which insures that the liquid or solid particles comprising atomization material which originate at the latest during the atomization are electrostatically strongly charged and thus move quickly and determinedly in the electrostatic field which is produced between the nozzle and the object to be coated. The charging is promoted by the somewhat sharp edges of the flange 28 and of the flange 38, over which the coating material moves during the exit through the mouth 62 into the atomization chamber 66.

While I have disclosed one embodiment of the invention, it is to be understood that this embodiment is given by example only and not in a limiting sense.

I claim:

1. In a round or annular jet nozzle for the production and emitting of a mist or aerosol for coating objects, including a nozzle cap forming an axial front end of the nozzle, a nozzle body mounting the cap, the nozzle body having at least two channels including a material feed channel means for feeding of flowable coating material such as lacquer or paint powder, and respectively, a first channel means for feeding of an atomization gas standing under pressure such as pressurized air, the two channels extending at least partly parallel to the nozzle axis, an annular-shaped atomization chamber into which the two channels exit approximately parallel, and with a conical annular gap for the exit of the mist and aerosol, respectively, the annular gap diverging forwardly with respect to the nozzle axis, the annular gap standing in connection with the atomization chamber, the improvement wherein the atomization chamber and the annular gap pass directly into one another, said material feed channel means constituting an annular-shaped material feed channel having a conical mouth defining an opening angle, the latter corresponding at least approximately to the opening angle of the annular gap, and said mouth is aligned with the annular gap, another channel means for feeding of the atomization gas standing under pressure, said first and another channel means form two annular-shaped gas feed channels respectively opening into the atomization chamber at a flat acute angle relative to said opening angle of said mouth of said material feed channel on different sides relative thereto, such that two annular-formed gas streams penetrate from the different sides substantially centrally into a material stream.

2. The nozzle according to claim 1, wherein said another channel means for feeding of the atomization gas extends partially in a radial plane, the nozzle body includes two axially assembled parts cooperatively forming said second channel means therebetween.

3. The nozzle according to claim 2, wherein the nozzle body includes an axial front part having a rear side formed with an annular-shaped hollow groove means for turning axially parallel inflowing atomization gas into said radial plane.

4. In a round or annular jet nozzle for the production and emitting of a mist or aerosol for coating objects, including a nozzle cap forming an axial front end of the nozzle, a nozzle body mounting the cap, the nozzle body having at least two channels including a material feed channel means for feeding of flowable coating material such as lacquer or paint powder, and respectively, a first channel means for feeding of an atomization gas standing under pressure such as pressurized air, the two channels extending at least partly parallel to the nozzle axis, an annular-shaped atomization chamber into which the two channels exit approximately parallel, and with a conical annular gap for the exit of the mist and aerosol, respectively, the annular gap diverging forwardly with respect to the nozzle axis, the annular gap standing in connection with the atomization chamber, the improvement wherein the atomization chamber and the annular gap pass directly into one another, said material feed channel means constituting an annular-shaped material feed channel having a conical mouth defining an opening angle, the latter corresponding at least approximately to the opening angle of the annular gap, and said mouth is aligned with the annular gap, another channel means for feeding of the atomization gas standing under pressure, said first and another channel means form two annular-shaped gas feed channels respectively opening into the atomization chamber under a flat acute angle relative to said mouth of said material feed channel on different sides relative thereto, such that two annular-formed gas streams penetrate from the different sides into a material stream, said another channel means for feeding of the atomization gas extends partially in a radial plane, the nozzle body includes two axially assembled parts cooperatively forming said second channel means therebetween, the nozzle body includes an axial rear part substantially comprising, a radial outer nozzle jacket, a radial inner flange part having a flange and formed with a plurality of bores exiting into said hollow groove means, and a radial center flange between said jacket and said flange part, the radial center flange cooperatively spaced together with said nozzle jacket and said flange part forming said first channel means for feeding the atomization gas, and said material feed channel, respectively, and a front side of said flange of said flange part together with the rear side of said front part of the nozzle body and said plurality of bores in said flange part form said another channel means for feeding the atomization gas.

5. In a round or annular jet nozzle for the production and emitting of a mist or aerosol for coating objects, including a nozzle cap forming an axial front end of the nozzle, a nozzle body mounting the cap, the nozzle body having at least two channels including a material feed channel means for feeding of flowable coating material such as lacquer or paint powder, and respectively, a first channel means for feeding of an atomization gas standing under pressure such as pressurized air, the two channels extending at least partly parallel to the nozzle axis, an annular-shaped atomization chamber into which the two channels exit approximately parallel, and with a conical annular gap for the exit of the mist and aerosol, respectively, the annular gap diverging forwardly with respect to the nozzle axis, the annular gap standing in connection with the atomization chamber, the improvement wherein the atomization chamber and the annular gap pass directly into one another, said material feed channel means constituting an annular-shaped material feed channel having a conical mouth defining an opening angle, the latter corresponding at least approximately to the opening angle of the annular gap, and said mouth is aligned with the annular gap, another channel means for feeding of the atomization gas standing under pressure, said first and another channel means form two annular-shaped gas feed channels respectively opening into the atomization chamber under a flat acute angle relative to said mouth of said material feed channel on different sides relative thereto, such that two annular-formed gas streams penetrate from the different sides into a material stream, the nozzle cap and the nozzle body form a second annular gap means for the exit of compressed guide air, said second annular gap means has a forwardly diverging conical mouth opening into the ambient defining an opening angle at most as large as the opening angle of the first mentioned annular gap for the exiting of the mist and aerosol, respectively, said first mentioned annular gap is located rearwardly relative to said second annular gap means.

6. The nozzle according to claim 5, wherein the nozzle cap is mounted on the nozzle body rotatably about the nozzle axis, said second annular gap means for providing a pneumatic drive of the nozzle cap by guide air exiting from said second annular gap means.

7. The nozzle according to claim 5, further comprising means for connecting both said first and second channel means and said second annular gap means to a common source of compressed air.

* * * * *